US010941737B2

(12) United States Patent
Abrahamson

(10) Patent No.: US 10,941,737 B2
(45) Date of Patent: Mar. 9, 2021

(54) FOLLOWER MECHANISM WITH ANTI-ROTATION FEATURE

(71) Applicant: Koyo Bearings North America LLC, Greenville, SC (US)

(72) Inventor: Scott Abrahamson, Piedmont, SC (US)

(73) Assignee: Koyo Bearings North America LLC, Greenville, SC (US)

( * ) Notice: Subject to any disclaimer, the term of this patent is extended or adjusted under 35 U.S.C. 154(b) by 0 days.

(21) Appl. No.: 16/731,859

(22) Filed: Dec. 31, 2019

(65) Prior Publication Data

US 2020/0224617 A1 Jul. 16, 2020

Related U.S. Application Data

(60) Provisional application No. 62/792,168, filed on Jan. 14, 2019.

(51) Int. Cl.
*F02M 37/04* (2006.01)

(52) U.S. Cl.
CPC ..... *F02M 37/04* (2013.01)

(58) Field of Classification Search
CPC ..... F02M 37/04; F02M 37/043; F02M 37/06; F02M 59/102
USPC ..... 123/495, 507, 508
See application file for complete search history.

(56) References Cited

U.S. PATENT DOCUMENTS

| | | | | |
|---|---|---|---|---|
| 8,474,427 | B2 * | 7/2013 | Dorn | F04B 9/04 123/90.48 |
| 10,260,614 | B2 * | 4/2019 | Van Der Mei | F02M 59/102 |
| 2016/0312665 | A1 | 10/2016 | Jouanno et al. | |
| 2019/0368485 | A1 * | 12/2019 | Cornett | F02M 59/102 |

FOREIGN PATENT DOCUMENTS

| | | | |
|---|---|---|---|
| JP | S62-141862 | A | 6/1987 |
| JP | S64-046404 | A | 2/1989 |
| JP | 2015-508139 | A | 3/2015 |
| JP | 2017-207202 | A | 11/2017 |
| KR | 10-2018-0129938 | A | 12/2018 |
| WO | 2017/181181 | A2 | 10/2017 |

* cited by examiner

*Primary Examiner* — Hai H Huynh
(74) *Attorney, Agent, or Firm* — Nelson Mullins Riley & Scarborough LLP

(57) ABSTRACT

A follower mechanism including an outer cup having a substantially cylindrical side wall, an annular lip portion disposed at a first end of the side wall, an annular ledge disposed on the side wall, the annular ledge being disposed in a plane that is transverse to a longitudinal center axis of the follower mechanism, and an anti-rotation device disposed on the annular ledge. An inner cup includes an annular lip extending radially-outwardly therefrom and a pair of shaft apertures, the inner cup being disposed in the outer cup so that the lip abuts the annular ledge of the outer cup as well as the anti-rotation devices so that the inner cup is non-rotatable with respect to the outer cup. A shaft is received in the shaft apertures, and a roller follower is rotatably received on the shaft.

17 Claims, 11 Drawing Sheets

FOLLOWER MECHANISM WITH ANTI-ROTATION FEATURE

CLAIM OF PRIORITY

This application claims priority to U.S. provisional patent application No. 62/792,168 filed Jan. 14, 2019, the disclosure of which is incorporated by reference herein.

FIELD OF THE INVENTION

The present invention relates generally to follower mechanisms. More particularly, the present invention relates to designs and assembly methods of follower mechanisms and their associated alignment devices.

BACKGROUND OF THE INVENTION

Follower mechanisms are often used in a valve train of an internal combustion engine to transmit motion from a camshaft of the engine to one or more intake or exhaust valves. As the camshaft rotates, the follower mechanisms receive both a sideways force and a downward force from corresponding lobes on the camshaft, but only transmit the downward force to the valves to open and/or close the valves. Follower mechanisms thereby reduce the possibility of bending or otherwise damaging the valve stems of the valves. As well, follower mechanisms are often used in camshaft driven, high-pressure fuel pumps which are used in gasoline direct injection (GDI) systems.

Existing bucket-type follower mechanisms typically include either a stamped or cold formed bucket. A roller follower is typically supported on a shaft that is directly fixed to the bucket such as by staking, swaging, etc. As such, the bucket is a load bearing member and, therefore, requires heat treatment and operations such as grinding. As well, follower mechanisms often have some form of alignment device extending radially-outwardly from the bucket such that rotation of the follower mechanism within its corresponding bore is prevented. One example of known alignment devices is a mushroom-shaped pin that is fixed in an aperture of the follower mechanism's bucket. Such pins can be difficult to manufacture because of their complicated shapes. Moreover, required heat treatments of the bucket can cause distortion of the aperture which receives the alignment device, thereby complicating assembly. Such alignment devices are often fixed in their corresponding apertures by an interference fit. As well, when a follower mechanism includes an inner bucket and an outer bucket, an anti-rotation device is often used to prevent relative rotation between the two buckets. The manufacture of two distinct alignment and anti-rotation devices can lead to increased manufacturing costs.

The present invention recognizes and addresses considerations of prior art constructions and methods.

SUMMARY OF THE INVENTION

One embodiment of the present disclosure provides a follower mechanism movable within a bore along a longitudinal center axis of the bore, the mechanism including an outer cup having an inner surface and an outer surface defining a substantially cylindrical side wall, an annular lip portion disposed at a first end of the side wall, an annular ledge disposed on the inner surface of the side wall, the annular ledge being disposed in a plane that is transverse to a longitudinal center axis of the follower mechanism, and an anti-rotation device disposed on the annular ledge. An inner cup includes an annular lip extending radially-outwardly therefrom and a pair of shaft apertures, the inner cup being disposed in the outer cup so that the lip of the inner cup abuts both the annular ledge and anti-rotation device of the outer cup so that the inner cup is non-rotatable with respect to the outer cup. A shaft having a first end and a second end, each of the first end and the second end being disposed in a corresponding one of the shaft apertures, and a roller follower rotatably received on the shaft such that a portion of the roller follower extends axially outwardly beyond the annular lip portion of the outer cup.

Another embodiment of the present disclosure provides an internal combustion engine assembly having a cylinder head including a bore, a camshaft rotatably supported within the cylinder head, the camshaft including a lobe, a fuel pump including a pump stem, a follower mechanism slidably disposed within the bore of the cylinder head, including an outer cup having an inner surface and an outer surface defining a substantially cylindrical side wall, a first annular lip portion disposed at a first end of the side wall, an annular ledge that is disposed at an intersection of the first end of the side wall and the first annular lip portion, and an anti-rotation device extending axially-outwardly from the annular ledge, wherein the first annular lip portion is thinner in a radial direction than the side wall, an inner cup including a side wall and an upper lip extending radially-outwardly from an upper perimeter of the inner cup, the inner cup being disposed in the outer cup so that a portion of the upper lip of the inner cup abuts the annular ledge of the outer cup and is axially fixed thereto by the first annular lip portion of the outer cup which abuts a top edge of the inner cup; and a roller follower rotatably received on the follower mechanism such that a portion of the roller follower extends axially outwardly beyond the first annular lip portion of the outer cup, wherein a portion of the upper lip of the inner cup abuts the anti-rotation device of the outer cup, thereby preventing relative rotation between the inner cup and the outer cup.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
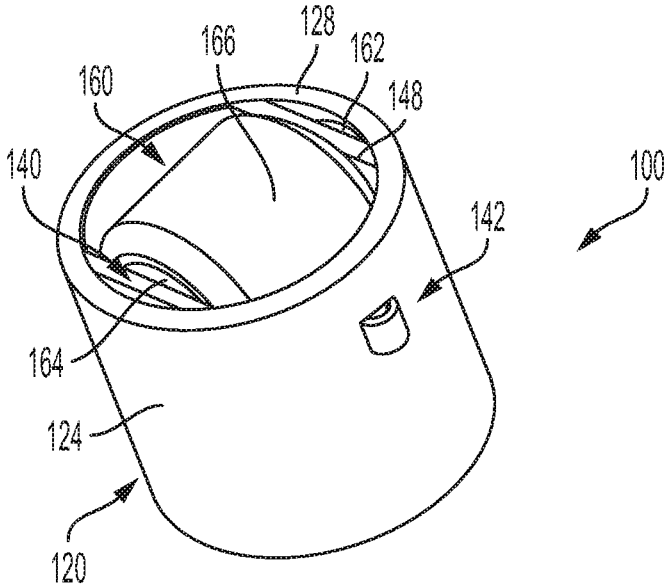
FIGS. 1A and 1B are perspective views of an embodiment of a follower mechanism in accordance with the present disclosure.
Figure 1B:
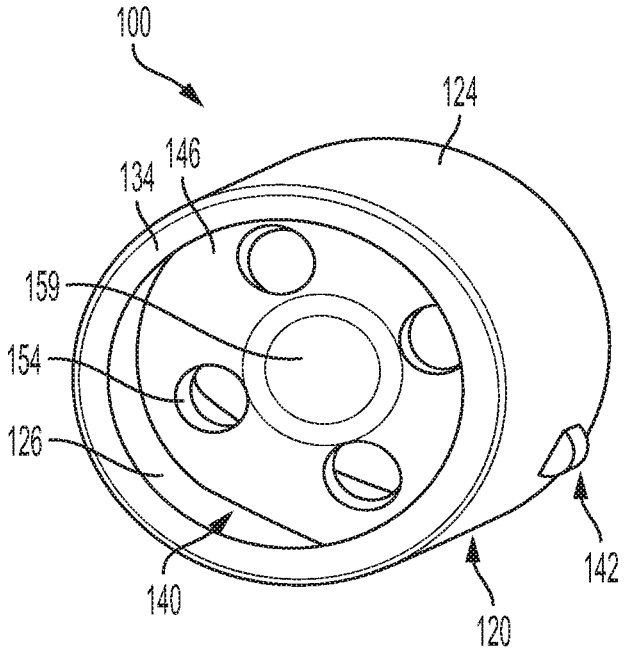

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the figures, as shown in FIGS. 1A through 3C, an embodiment of a follower mechanism 100 in accordance with the present disclosure includes a substantially cylindrical outer cup 120, an inner cup 140 received therein, a roller follower 160 supported by inner cup 140, an alignment device 142 formed in outer cup 120 and an anti-rotation device 141 (FIG. 7A) formed by portions of the inner and outer cups, as discussed in greater detail below. As shown in FIG. 8, follower mechanism 100 is used in a high-pressure fuel pump 180 of an internal combustion engine, although other uses for follower mechanism 100 are possible. As a camshaft 182 of the engine rotates, a lobe 184 of camshaft 182, or a rocker arm (not shown) connected to camshaft 182, engages roller follower 160 of follower mechanism 100 to convert the rotational motion of camshaft 182 into linear motion of follower mechanism 100 within a bore 186 of a corresponding cylinder head 188. A pump stem 190 of pump 180 is positioned within and connected to follower mechanism 100 such that, as follower mechanism 100 moves in a linear direction within bore 186, pump stem 190 is alternatingly moved left (as shown) by spring 192 and right by follower mechanism 100. Forces from camshaft 182 are thereby transmitted through follower mechanism 100 to pump 180 such that only forces in substantially the same direction as the motion of pump stem 190 act on pump 180. In addition, follower mechanism 100 serves as a torsional vibration isolation device between camshaft 182 and pump 180 to inhibit rotational forces from being transmitted. As shown, alignment device 142 is an outwardly-extending, semi-cylindrical protrusion that is preferably lanced or formed into the side wall of outer cup 120 prior to any heat treatment processes.

Figure 5:
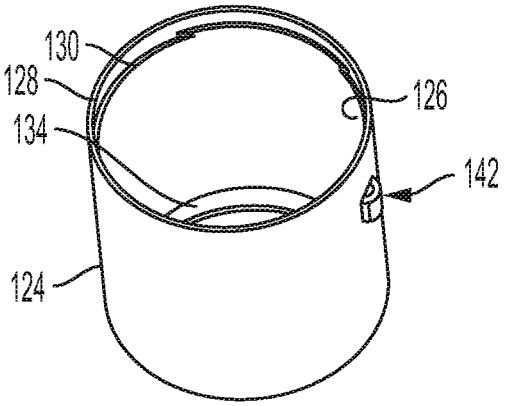
FIG. 5 is a perspective view of an outer cup of the follower mechanism shown in FIGS. 1A and 1B.
Figure 7A:
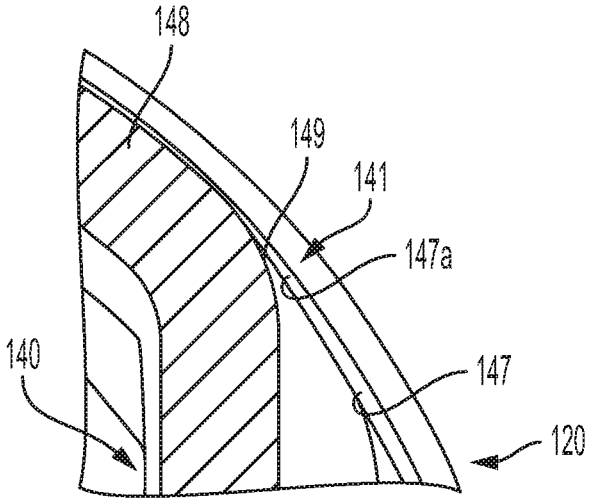
FIGS. 7A and 7B are partial views of the anti-rotation feature shown in FIG. 6A.
Figure 8:
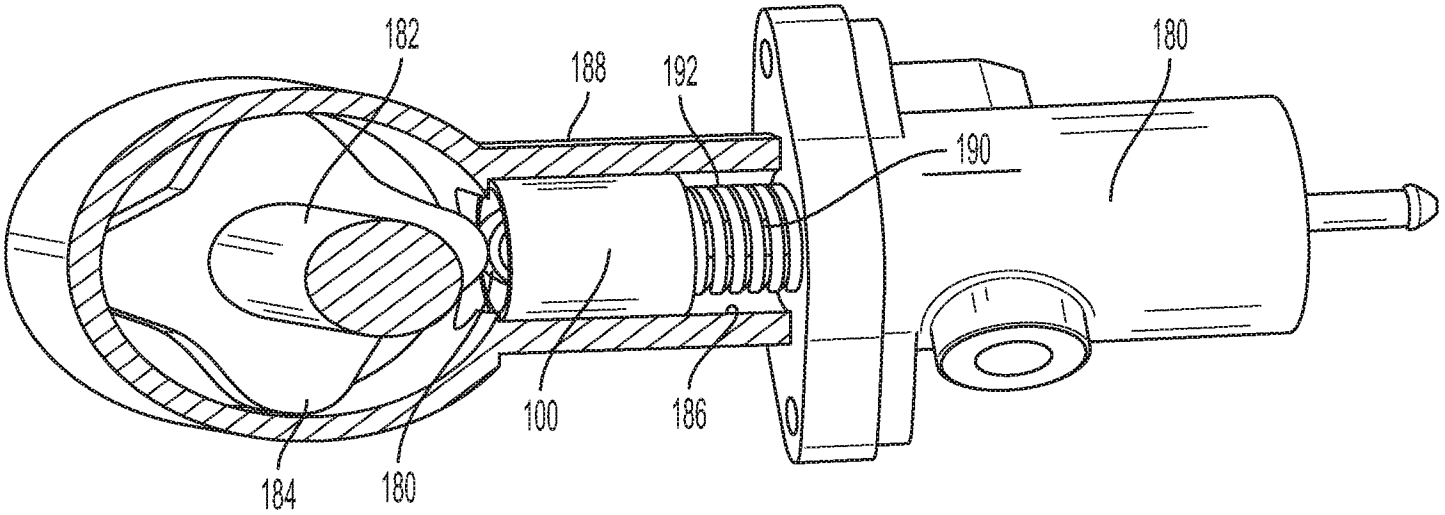
FIG. 8 is a partial cross-sectional view of a high pressure fuel pump including the follower mechanism shown in FIGS. 1A and 1B.
Figure 9A:
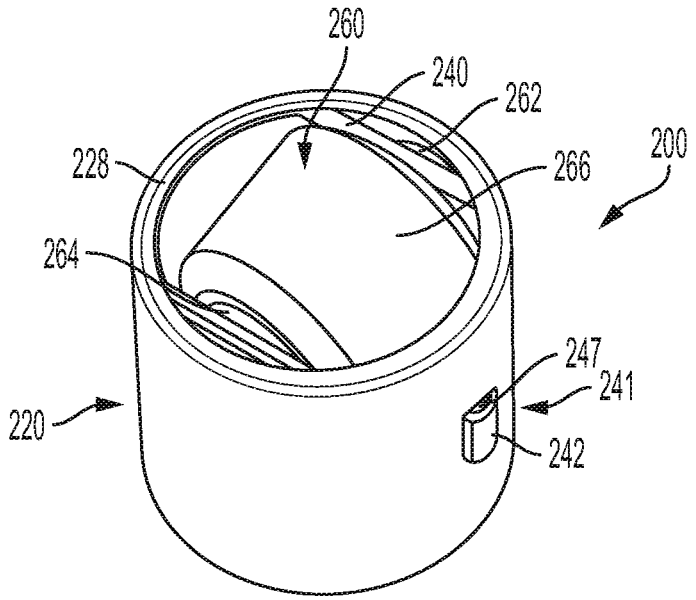
FIGS. 9A and 9B are perspective views of another alternate embodiment of a follower mechanism in accordance with the present disclosure.
Figure 9B:
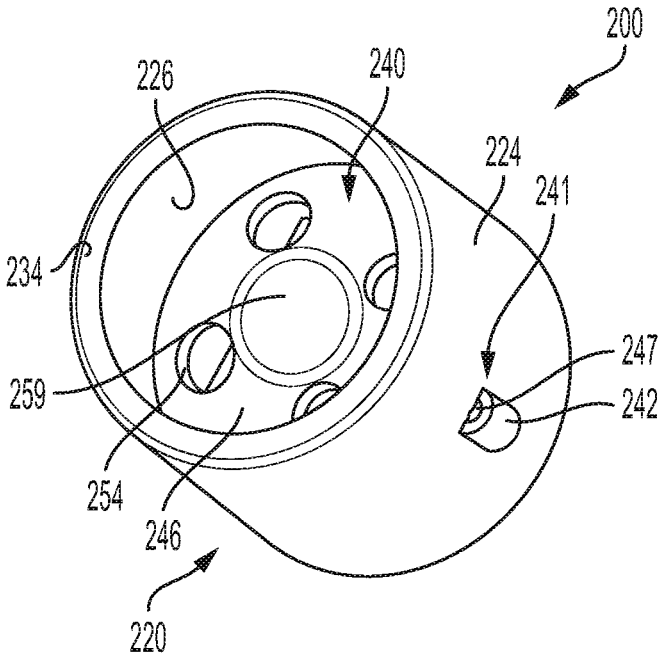

Referring additionally to FIG. 5, outer cup 120 of the present embodiment includes a cylindrical outer surface 124, a cylindrical inner surface 126 that is substantially concentric therewith, alignment device 142, and anti-rotation device 141 (FIG. 7A). Outer cup 120 is preferably formed from a sheet metal blank of low, medium, or high carbon plain or alloy steel by a stamping process, or deep drawing process using a multi-station transfer or progressive press. Additionally, outer cup 120 includes an annular lip 128 and 134 formed at each of its opposing ends. Annular lip 128 is thinner in the radial direction than the remaining side wall of outer cup 120, forming an annular ledge 130 therewith. In its initial state, prior to fully assembling follower mechanism 100, annular lip 128 extends axially outwardly parallel to a longitudinal center axis of outer cup 120, whereas annular ledge 130 lies in a plane that is transverse to the longitudinal center axis. When forming outer cup 120, annular lip 134 may be initially formed depending radially-inwardly as the other components of the roller follower are preferably placed into outer cup 120 from the end at which annular lip 128 is disposed.

Figure 4A:
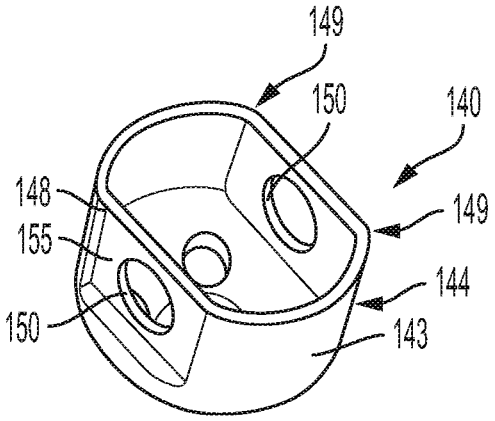
FIGS. 4A and 4B are perspective views of an inner cup of the follower mechanism shown in FIGS. 1A and 1B.
Figure 4B:
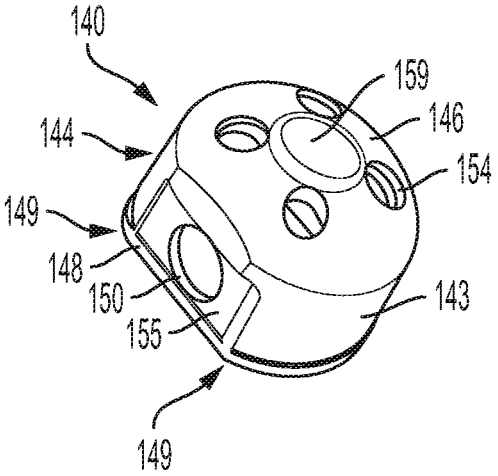

Referring additionally to FIGS. 4A and 4B, inner cup 140 preferably includes a side wall 144 including two opposed curved portions 143 with two parallel side portions 155 extending therebetween, a semi-spherical bottom portion 146, an upper lip 148 extending radially-outwardly from an upper perimeter of side wall 144, and a pair of shaft apertures 150 defined by side wall 144. Upper lip 148 defines a corner 149 at the intersection of each curved portion 143 and side portion 155 of the inner cup's side wall 144.

Figure 3A:
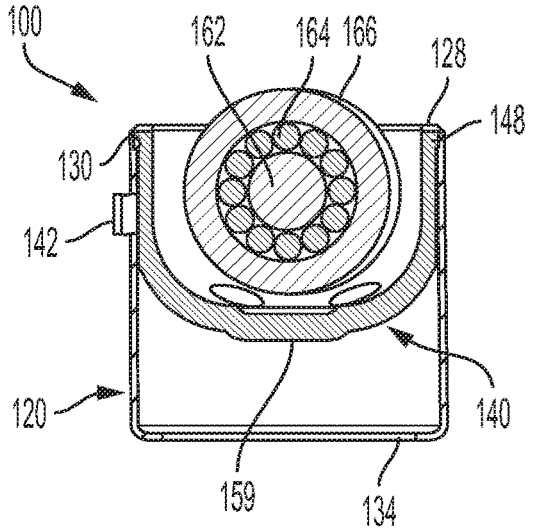
FIGS. 3A, 3B, and 3C are cross-sectional views of the follower mechanism shown in FIGS. 1A and 1B.
Figure 3B:
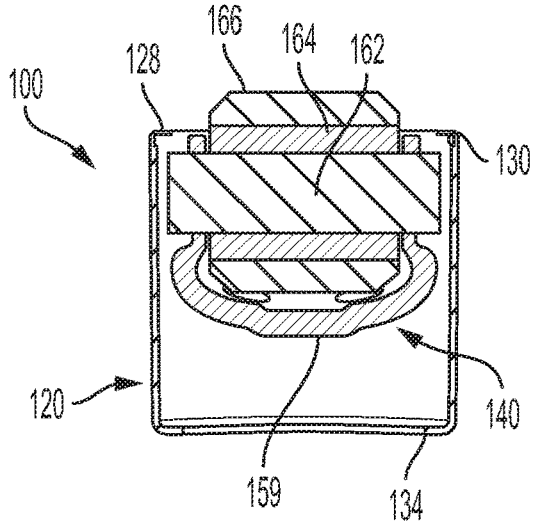
Figure 3C:
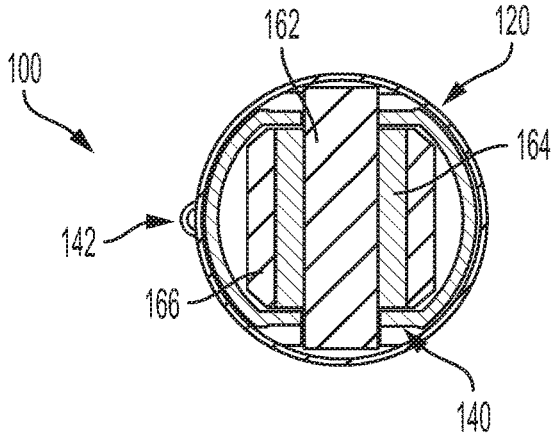
Figure 6A:
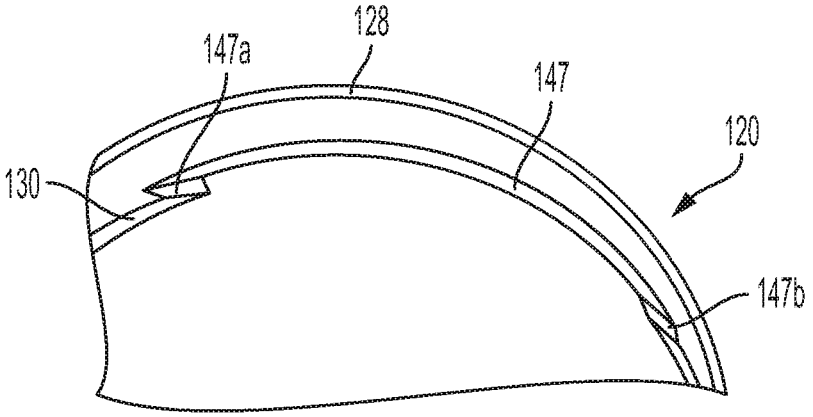
FIGS. 6A, 6B, 6C, and 6D are perspective views of various embodiments of anti-rotation features present on the outer cup of the presently disclosed follower mechanisms.
Figure 7B:
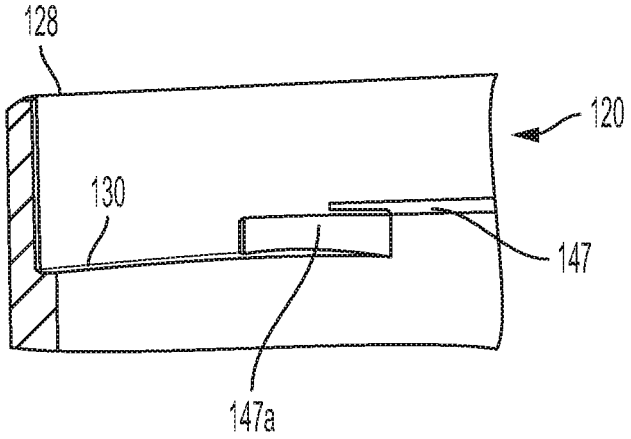

Referring now to FIG. 6A, a first embodiment of an anti-rotation device in accordance with the present description includes at least one protrusion 147 extending axially-upwardly from annular ledge 130 of outer cup 120. As shown, protrusion 147 extends along annular ledge 130 for a length that is substantially the same as the distance between a pair of corners 149 that are separated by a corresponding side portion 155 of inner cup 140. As such, as best seen in FIGS. 3A, 7A and 7B, when inner cup 140 is fully inserted in outer cup 120, upper lip 148 of inner cup 140 rests on annular ledge 130 of outer cup 120 such that each of the noted corners 149 of upper lip 148 abut a corresponding end portion 147*a* and 147*b* of protrusion 147, thereby preventing rotation of inner cup 140 with respect to outer cup 120 and insuring proper alignment of inner cup 140 within outer cup 120. In the present embodiment, end portions 147*a* and 147*b* are correspondingly-shaped to the corners 149 of upper lip 148, as shown in FIG. 7A. Preferably, although only one protrusion 147 can be used, two protrusions 147 extend between the corresponding sets of corners 149 of upper lip 148 to maintain symmetry outer cup 120. Note, inner cup 140 may be inserted directly into outer cup 120 without tilting.

Figure 6B:
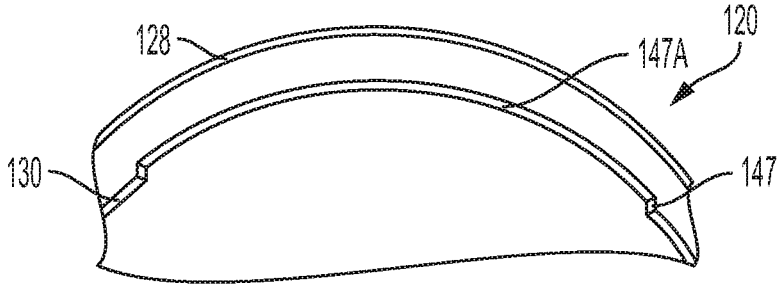
Figure 6C:
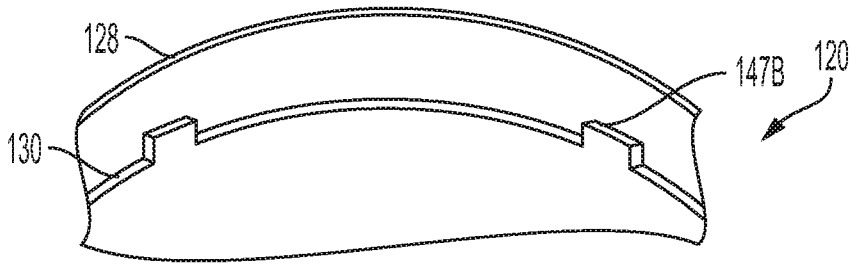
Figure 6D:
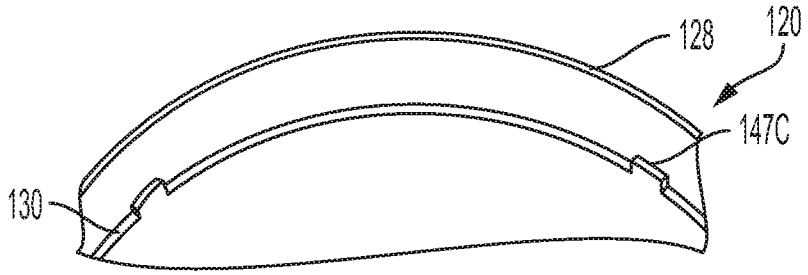

Referring now to FIGS. 6B, 6C and 6D, alternate embodiments of anti-rotation protrusions are shown. As shown in FIG. 6B, in an alternate embodiment, the end portions of protrusion 147A need not be shaped similarly to corners 149 of upper lip. As shown in FIGS. 6C and 6D, rather than utilizing protrusions that extend the entire length of ledge 30 between corners 149 of inner cup 140, pairs of protrusions 147B and 147C, respectively, can be utilized to abut the corners. Note, in each embodiment the axial height of the protrusion is less than the axial height of annular lip 128 so as not to interfere in bending annular lip 128 radially-inwardly during assembly, as discussed below.

Once fully inserted in outer cup 120 and rotationally positioned by way of anti-rotation device 141, inner cup 140 is retained therein by folding annular lip 128 over inwardly, such as by crimping, spin curling, punch forming, etc., so that upper lip 148 is non-rotatably squeezed between annular lip 128 and annular ledge 130. Note, in alternate embodiments, a spacer (not shown), such as a circular washer, may be positioned between annular lip 128 and annular ledge 130. The spacer helps insure that any potential gaps between lip 128 and ledge 130 are minimized. Spacers are preferably formed from a plastic or a like material. Note, since outer cup 120 does not directly support shaft 162 of roller follower 160, it does not require the heat treatment processes that are typically performed on the outer cups of known follower mechanisms. As such, the folding/crimping operation performed on annular lip 128 is facilitated. However, in those applications where heat treatment of outer cup 120 is desired for wear purposes, the heat treatment process occurs after alignment device 142 is formed. As shown, alignment device 142 includes a semi-cylindrical outer surface that is correspondingly shaped to the alignment groove (not shown) that is formed in the corresponding cylinder head 188 (FIG. 8). Next, prior to folding, crimping, etc., annular lip 128 over inwardly, annular lip 128 is tempered to facilitate the operation and help prevent cracking.

Preferably, inner cup 140 is formed from a sheet metal blank by a stamping process, or drawing process, and is subjected to heat treatment processes as it directly supports shaft 162 of follower mechanism 100. Initially, side wall 144 is substantially cylindrical when inner cup 140 is formed. However, prior to the heat treatment process, flat side portions 145 are formed, resulting in the side portions 145 extending between two opposed curved portions 143. As well, prior to the heat treatment processes, shaft apertures 150 are pierced in flat side portions 145 of inner cup 140. Lubrication apertures 154 are also pierced in semi-spherical bottom portion 146 of inner cup 140 prior to any heat treatment processes. A portion of semi-spherical bottom portion 146 may be flattened, thereby forming a bottom wall 159 that is perpendicular to longitudinal center axis 132 of follower mechanism 100.

Figure 2:
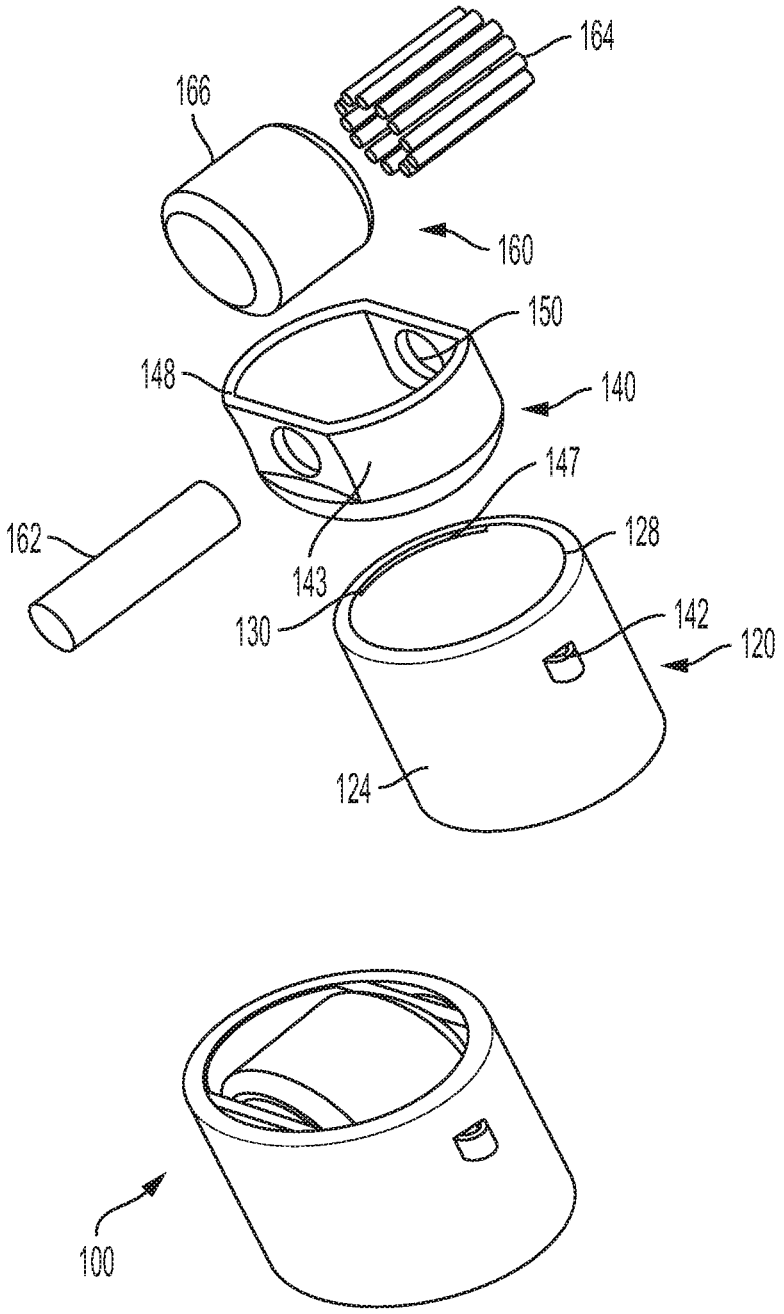
FIG. 2 is an exploded perspective view of the follower mechanism shown in FIGS. 1A and 1B.

As best seen in FIG. 2, roller follower 160 includes shaft 162, an outer race 166, and a plurality of rollers 164 disposed therebetween such that race 166 is freely rotatable about shaft 162. Opposite ends of shaft 162 are received in shaft apertures 150 of inner cup 140 such that roller follower 160 is mounted to outer cup 120 of follower mechanism 100 by way of the inner cup. When assembled, roller follower 160 extends axially outwardly beyond the top edge of outer cup 120 such that outer surface of race 166 engages a corresponding lobe 184 of camshaft 182, as shown in FIG. 8. Preferably, the diameters of shaft apertures 150 are slightly larger than the diameter of shaft 162 such that shaft 162 is free to rotate within shaft apertures 150 during operation. Alternately, the opposing ends of shaft 162 can be staked, swaged, etc., to inner cup 140 such that rotation relative thereto is prevented. Note, when shaft 162 is free to rotate within shaft apertures 150, the axial motion of shaft 162 is limited by abutment at either end with inner surface 126 of outer cup 120. Preferably, annular beveled edges 168 are provided on the opposite ends of outer race 166 to allow the overall size of outer race 166 to be maximized, yet not make contact with the inner surface of semi-spherical bottom portion 146 of inner cup 140.

As shown in FIGS. 9A through 11C, an alternate embodiment of a follower mechanism 200 in accordance with the present disclosure includes a substantially cylindrical outer cup 220, an inner cup 240 received therein, a roller follower 260 supported by inner cup 240, an alignment device 242 formed in outer cup 220, and an anti-rotation device 241 formed by a cylindrical pin 247 that is received in both alignment device 242 and a recess 249 (FIG. 10) formed on inner cup 240, as discussed in greater detail below. Similarly to the previously described embodiment, follower mechanism 200 may be used in a high-pressure fuel pump 180 (FIG. 8) of an internal combustion engine, although other uses for follower mechanism 200 are possible.

Figure 13:
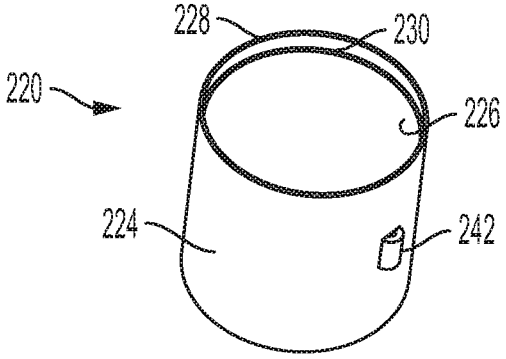
FIG. 13 is a perspective view of an outer cup of the follower mechanism shown in FIGS. 9A and 9B.

Referring additionally to FIG. 13, outer cup 220 includes a cylindrical outer surface 224, a cylindrical inner surface 226 substantially concentric therewith, and alignment device 242. Outer cup 220 is preferably formed from a sheet metal blank of low, medium or high carbon plain or alloy steel by a stamping process, or deep drawing process using a multi-station transfer or progressive press. Additionally, outer cup 220 includes an annular lip 228 and 234 formed at each of its opposing ends. Annular lip 228 is thinner in the radial direction than the remaining side wall of outer cup 220, forming an annular ledge 230 therewith. Prior to fully assembling follower mechanism 200, annular lip 228 extends axially outwardly parallel to a longitudinal center axis 232 of outer cup 220, whereas annular ledge 230 lies in a plane that is transverse to longitudinal center axis 232. When forming outer cup 220, annular lip 234 may be initially formed depending radially inwardly as the other components of the roller follower are preferably placed into outer cup 220 from the end at which annular lip 228 is disposed. Outer cup 220 of the present embodiment differs primarily from outer cup 120 of the first embodiment in that it does not include the anti-rotation feature 141 on the annular ledge 230 of its inner surface.

Figure 11A:
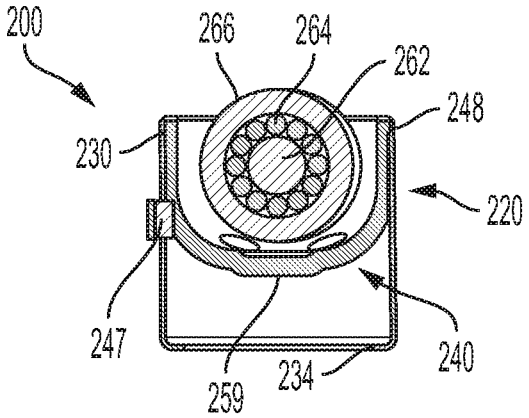
FIGS. 11A, 11B, 11C, and 11D are cross-sectional views of the follower mechanism shown in FIGS. 9A and 9B.
Figure 11B:
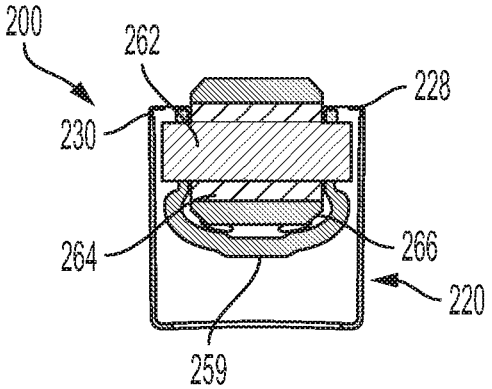
Figure 11C:
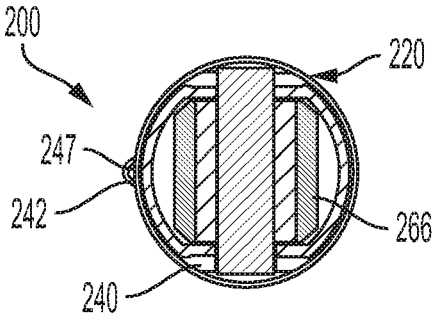
Figure 11D:
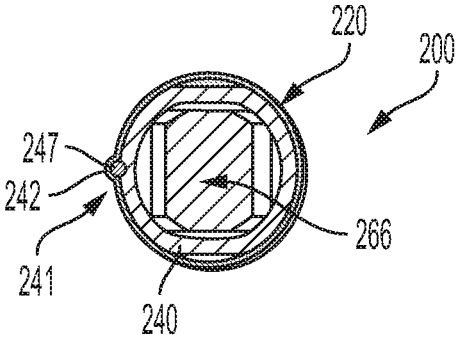
Figure 12A:
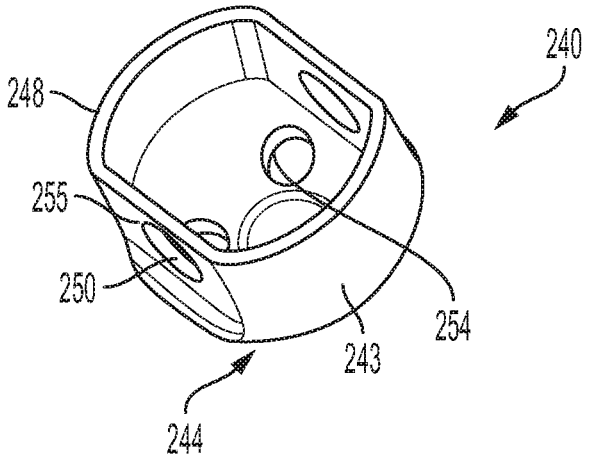
FIGS. 12A and 12B are perspective views of an inner cup of the follower mechanism shown in FIGS. 9A and 9B.
Figure 12B:
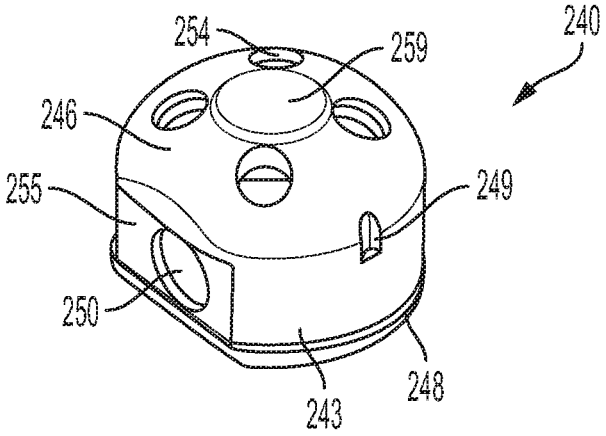

Referring additionally to FIGS. 12A and 12B, inner cup 240 preferably includes a side wall 244 including two opposed curved portions 243 with two parallel side portions 255 extending therebetween, a semi-spherical bottom portion 246, an upper lip 248 extending radially outwardly from an upper perimeter of side wall 244, a pair of shaft apertures 250 defined by side wall 244, and a semi-cylindrical recess 249 formed in one of the curved portions 243. As best seen in FIG. 11A, when inner cup 240 is fully inserted in outer cup 220, upper lip 248 of inner cup 240 rests on annular ledge 230 of outer cup 220 and pin 251 is received within both alignment device 246 and recess 249. Also as shown in FIGS. 11C and 11D, proper alignment of inner cup 240 within outer cup 220 is maintained by anti-rotation device 241 since pin 251 engages both alignment device 242 and recess 249 simultaneously. Note, inner cup 240 may be inserted directly into outer cup 220 without tilting if pin 251 is inserted in alignment device 242 prior to inserting inner cup 240 in outer cup 220 since pin 251 is slidably received within recess 249 formed in inner cup 240.

Once fully inserted in outer cup 220 and rotationally positioned by way of inner cup 240 is retained therein by folding annular lip 228 over inwardly, such as by crimping, spin curling, punch forming, etc., so that upper lip 248 is non-rotatably squeezed between annular lip 228 and annular ledge 230. Note, since outer cup 220 does not directly support shaft 262 of roller follower 260, it does not require the heat treatment processes that are typically performed on the outer cups of known follower mechanisms. As such, the folding/crimping operation performed on annular lip 228 is facilitated. However, in those applications where heat treatment of outer cup 220 is desired for wear purposes, the heat treatment process occurs after alignment device 242 is formed. As shown, alignment device 242 includes a semi-cylindrical outer surface that is correspondingly shaped to the alignment groove (not shown) that is formed in the corresponding cylinder head 288 (FIG. 8). As such, the inner surface of alignment device 242 is also semi-cylindrical and shaped so as to receive pin 251 of anti-rotation device 241 therein. Prior to folding, crimping, etc., annular lip 228 over inwardly, annular lip 228 is tempered to facilitate the operation and help prevent cracking.

Preferably, inner cup 240 is formed from a sheet metal blank by a stamping process, or drawing process, and is subjected to heat treatment processes as it directly supports shaft 262 of follower mechanism 200. Initially, side wall 244 is substantially cylindrical when inner cup 240 is formed. However, prior to the heat treatment process, flat side portions 245 are formed, resulting in the side portions 245 extending between two opposed curved portions 243. As well, prior to the heat treatment processes, shaft apertures 250 are pierced in flat side portions 245 of inner cup 240. Lubrication apertures 254 are also pierced in semi-spherical bottom portion 246 of inner cup 240 prior to any heat treatment processes. A portion of semi-spherical bottom portion 246 may be flattened, thereby forming a bottom wall 259 that is perpendicular to the longitudinal center axis of follower mechanism 200.

Figure 10:
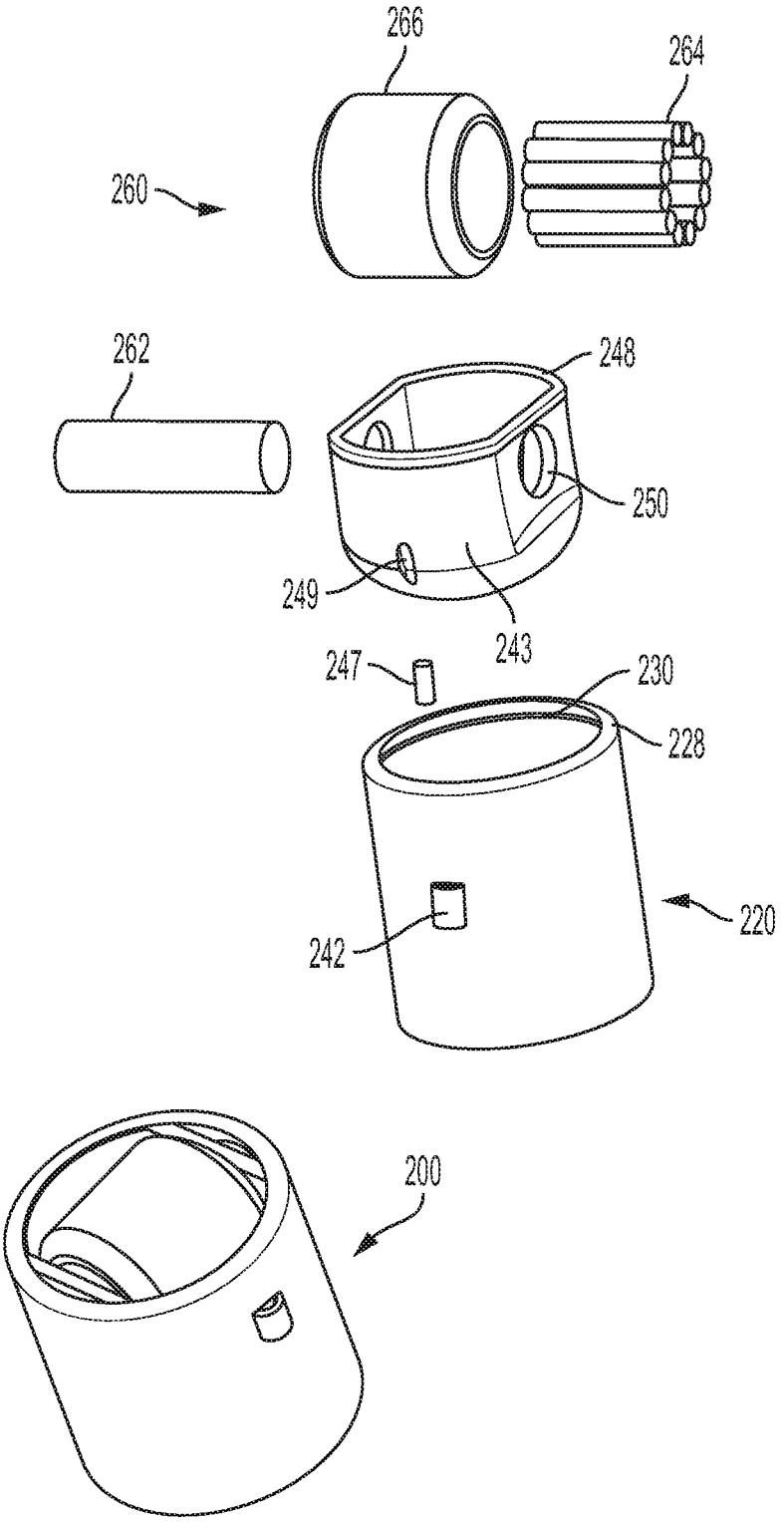
FIG. 10 is an exploded perspective view of the follower mechanism shown in FIGS. 9A and 9B.

As best seen in FIG. 10, roller follower 260 includes shaft 262, an outer race 266, and a plurality of rollers 264 disposed therebetween such that race 266 is freely rotatable about shaft 262. Opposite ends of shaft 262 are received in shaft apertures 250 of inner cup 240. When assembled, roller follower 260 extends axially outwardly beyond the top edge of outer cup 220 such that outer surface of race 266 engages a corresponding lobe 184 of camshaft 182, as shown in FIG. 8. Preferably, the diameters of shaft apertures 250 are slightly larger than the diameter of shaft 262 such that shaft 262 is free to rotate therein. Alternately, the opposing ends of shaft 262 can be staked, swaged, etc., to inner cup 240 such that rotation relative thereto is prevented. Note, when shaft 262 is free to rotate within shaft apertures 250, the axial motion of shaft 262 is limited by abutment at either end with inner surface 226 of outer cup 220. Preferably, annular beveled edges 268 are provided on the opposite ends of outer race 266 to allow the overall size of outer race 266 to be maximized, yet not make contact with the rounded bottom corners of inner cup 240.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A follower mechanism movable within a bore along a longitudinal center axis of the bore, comprising:

an outer cup having an inner surface and an outer surface defining a substantially cylindrical side wall, a first annular lip portion disposed at a first end of the side wall, a second annular lip portion disposed at a second end of the side wall, an annular ledge that is disposed at an intersection of the first end of the side wall and the first annular lip portion, and an anti-rotation device extending axially-outwardly from the annular ledge, wherein the first annular lip portion is thinner in a radial direction than the side wall;

an inner cup including a side wall, a pair of shaft apertures, and an upper lip extending radially-outwardly from an upper perimeter of the inner cup, the inner cup being disposed in the outer cup so that a portion of the upper lip of the inner cup abuts the annular ledge of the outer cup and is axially fixed thereto by the first annular lip portion of the outer cup which abuts a top edge of the inner cup;

a shaft having a first end and a second end, each of the first end and the second end being disposed in a corresponding one of the shaft apertures; and a roller follower rotatably received on the shaft such that a portion of the roller follower extends axially outwardly beyond the first annular lip portion of the outer cup;

wherein a portion of the upper lip of the inner cup abuts the anti-rotation device of the outer cup, thereby preventing relative rotation between the inner cup and the outer cup.

2. The follower mechanism of claim 1, wherein the roller follower further comprises:

a plurality of rollers and an outer race, wherein the plurality of rollers is disposed between an outer surface of the shaft and an inner surface of the outer race.

3. The follower mechanism of claim 1, wherein:

the side wall of the inner cup includes two opposed curved portions, two parallel side portions extending therebetween, and corners formed between adjacent curved portions and side portions;

the upper lip of the inner cup includes two opposed curved portions, two parallel side portions extending therebetween, and corners formed between adjacent curved portions and side portions, and wherein the two curved portions of the upper lip of the inner cup abut the annular ledge of the outer cup.

4. The follower mechanism of claim 3, wherein the anti-rotation device includes at least one protrusion extending axially-outwardly from the annular ledge toward a first end of the outer cup.

5. The follower mechanism of claim 4, wherein the at least one protrusion includes opposed end surfaces and extends circumferentially along the annular ledge so that each end surface abuts a corresponding corner of the upper lip of the inner cup.

6. The follower mechanism of claim 5, wherein the end surfaces of the at least one protrusion are correspondingly-shaped to the corners of the upper lip of the inner cup.

7. The follower mechanism of claim 4, wherein the at least one protrusion includes four protrusions, each protrusion abutting a corresponding corner of the upper lip of the inner cup.

8. The follower mechanism of claim 4, wherein an axial height of the at least one protrusion is less than an axial height of the annular lip of the outer cup.

9. An internal combustion engine assembly, comprising:

a cylinder head including a bore;

a camshaft rotatably supported within the cylinder head, the camshaft including a lobe;

a fuel pump including a pump stem; and a follower mechanism slidably disposed within the bore of the cylinder head, comprising:

an outer cup having an inner surface and an outer surface defining a substantially cylindrical side wall, a first annular lip portion disposed at a first end of the side wall, an annular ledge that is disposed at an intersection of the first end of the side wall and the first annular lip portion, and an anti-rotation device extending axially-outwardly from the annular ledge, wherein the first annular lip portion is thinner in a radial direction than the side wall;

an inner cup including a side wall and an upper lip extending radially-outwardly from an upper perimeter of the inner cup, the inner cup being disposed in the outer cup so that a portion of the upper lip of the inner cup abuts the annular ledge of the outer cup and is axially fixed thereto by the first annular lip portion of the outer cup which abuts a top edge of the inner cup; and a roller follower rotatably received on the follower mechanism such that a portion of the roller follower extends axially outwardly beyond the first annular lip portion of the outer cup;

wherein a portion of the upper lip of the inner cup abuts the anti-rotation device of the outer cup, thereby preventing relative rotation between the inner cup and the outer cup.

10. The internal combustion engine assembly of claim 9, wherein the side wall of the inner cup defines a pair of shaft apertures, and the follower mechanism further comprises a shaft having a first end and a second end, each of the first end and the second end being disposed in a corresponding one of the shaft apertures, and the roller follower is rotatably received on the shaft.

11. The internal combustion engine assembly of claim 10, wherein the roller follower further comprises:

a plurality of rollers and an outer race, wherein the plurality of rollers is disposed between an outer surface of the shaft and an inner surface of the outer race.

12. The internal combustion engine assembly of claim 9, wherein:

the side wall of the inner cup includes two opposed curved portions, two parallel side portions extending therebetween, and corners formed between adjacent curved portions and side portions, the upper lip of the inner cup includes two opposed curved portions, two parallel side portions extending therebetween, and corners formed between adjacent curved portions and side portions, and wherein the two curved portions of the upper lip of the inner cup abut the annular ledge of the outer cup.

13. The internal combustion engine assembly of claim 12, wherein the anti-rotation device includes at least one protrusion extending axially-outwardly from the annular ledge toward a first end of the outer cup.

14. The internal combustion engine assembly of claim 13, wherein the at least one protrusion includes opposed end surfaces and extends circumferentially along the annular ledge so that each end surface abuts a corresponding corner of the upper lip of the inner cup.

15. The internal combustion engine assembly of claim 14, wherein the end surfaces of the at least one protrusion are correspondingly-shaped to the corners of the upper lip of the inner cup.

16. The internal combustion engine assembly of claim 13, wherein the at least one protrusion includes four protrusions, each protrusion abutting a corresponding corner of the upper lip of the inner cup.

17. The internal combustion engine assembly of claim 13, wherein an axial height of the at least one protrusion is less than axial height of the annular lip of the outer cup.

* * * * *